United States Patent [19]

Zabel

[11] Patent Number: 4,462,231

[45] Date of Patent: Jul. 31, 1984

[54] PADLOCK

[75] Inventor: Herbert E. Zabel, Wheaton, Ill.

[73] Assignee: American Home Products Corporation, New York, N.Y.

[21] Appl. No.: 414,010

[22] Filed: Sep. 2, 1982

[51] Int. Cl.[3] ..... E05B 37/10

[52] U.S. Cl. ..... 70/21; 70/285

[58] Field of Search ..... 70/284, 21, 285

[56] References Cited

U.S. PATENT DOCUMENTS

| | | | |
|---|---|---|---|
| 2,487,608 | 11/1949 | Soref et al. | 70/21 |
| 2,926,514 | 3/1960 | Junkunc | 70/21 |
| 3,009,345 | 11/1961 | Check | 70/21 |
| 3,472,049 | 10/1969 | Sewell | 70/21 |
| 4,055,972 | 11/1977 | Calegan | 70/21 |
| 4,170,884 | 10/1979 | Calegan | 70/21 |

*Primary Examiner*—Thomas J. Holko
*Assistant Examiner*—Thomas J. Dubnicka
*Attorney, Agent, or Firm*—Robert D. Teichert

[57] ABSTRACT

A padlock having a permutation mechanism and a key mechanism, either of which can be operated to actuate a locking mechanism to lock and unlock the padlock, wherein the key mechanism is an integral part of the locking mechanism.

5 Claims, 14 Drawing Figures

12
12b
16b
14.
13
11
52
50
57
59
60
63
20
56
38
46
76
73
48
78
44
77
45
72
54
58
64
36
30
35
66
15
12a
16a
14
69
62
21
16
13.
14.

3.
12
12b
44
14
45
78
76
40
70
48
38
30
21
18
19
36
33
31
28
16
75
41
26
29
27
23
22

2.
10
12
12a
12b
11
14
15
22
24
23
0
4
8
12
16
20
24
28
32
36
40
44

PADLOCK

BACKGROUND OF THE INVENTION

This invention relates to locks and more particularly to padlocks which may be unlocked either by a key or by a permutation mechanism.

A permutation padlock, more commonly known as a combination padlock, is a popular type of lock since it obviates the need for a key which the owner may not always have available when operation of the lock is required. The combination padlock is widely used in schools, athletic clubs and other similar institutions, and many times it is specified by the authorities of such institutions.

The usefulness and convenience of combination padlocks is somewhat diminished when, for whatever reasons, unlocking the padlock by the owner or some other authorized person is not possible since the combination of numbers needed to operate the combination mechanism is either not known or not readily available.

Centralized record keeping of the various number combinations for each lock is the usual means for overcoming this problem, but this is a cumbersome procedure and is also an added operating expense.

Accordingly, it is desirable to incorporate in the combination lock a key operated mechanism which can operate separately from the combination mechanism to open the padlock. A master key may be employed to accommodate all the combination locks in the institution or specified system.

Padlocks having both mechanisms, combination and key, for releasing the locking elements of the padlock are known in the marketplace. However, such a key mechanism is normally designed to function separately from the combination mechanism and it invariably involves operating elements that are complex in fabrication as well as in operation. Such dual locks are usually nothing more than two different locking mechanisms squeezed into one lock casing.

With the above background in mind, it is an object of the present invention to provide a dual combination and key padlock wherein the key controlled mechanism is incorporated in the combination mechanism whereby through either mechanism the lock may be opened.

Another object of the invention is to provide a dual combination and key padlock wherein the shackle of the lock is releasably engaged by a locking bolt, which bolt is releasable by operation of either the combination mechanism or the key mechanism.

A further object of the invention is to provide a dual combination and key padlock wherein the key mechanism is part of and integral with the padlock locking mechanism.

A still further object of the invention is to provide a dual combination and key padlock wherein the key mechanism is integral with a bolt releasably engaging the lock shackle and operable, in selective positions, to either release the bolt from engagement with the shackle exclusive of the operation of the combination mechanism, or move with the bolt when it is released from engagement with the shackle by operation of the combination mechanism.

A yet further object of the invention is to provide a dual combination and key padlock which is compact in construction, efficient in operation, and designed to be inexpensive in fabrication.

SUMMARY OF THE INVENTION

This invention contemplates a padlock which is constructed to provide a combination mechanism and a key mechanism, either of which can be used to operate the padlock locking mechanism.

The locking mechanism comprises a bolt and a bolt housing wherein said bolt is disposed to engage a portion of the padlock shackle to prevent withdrawal of the shackle from the body of the padlock. A key cylinder mounted in the bolt housing can be rotated to selectively maintain the bolt in an extended position for engaging the shackle or move the bolt to a position wherein the bolt does not engage the shackle. When the bolt does not engage the shackle the key mechanism can be said to have made the locking mechanism inoperative to prevent movement of the shackle out of the padlock body, and the padlock is unlocked; however, when the bolt does not engage the shackle then manipulation of the combination mechanism is necessary in order to make the locking mechanism inoperative and unlock the padlock.

In its simplest form, the key mechanism is a part of the locking mechanism inasmuch as the key cylinder is in a positive abutting arrangement with the bolt at all times. Thus, when the locking mechanism is operative to engage the shackle, the key cylinder is operative in maintaining the integrity of the locking mechanism; and, accordingly, when the locking mechanism is moved out of engagement with the shackle the key cylinder moves with it.

Unlike known dual combination and key padlock construction, the key mechanism of my invention is a working element of the locking mechanism. Thus, the key mechanism is involved in a positive and functional manner even when the combination mechanism is operated to unlock the padlock.

DESCRIPTION OF A PREFERRED EMBODIMENT

Figure 3:
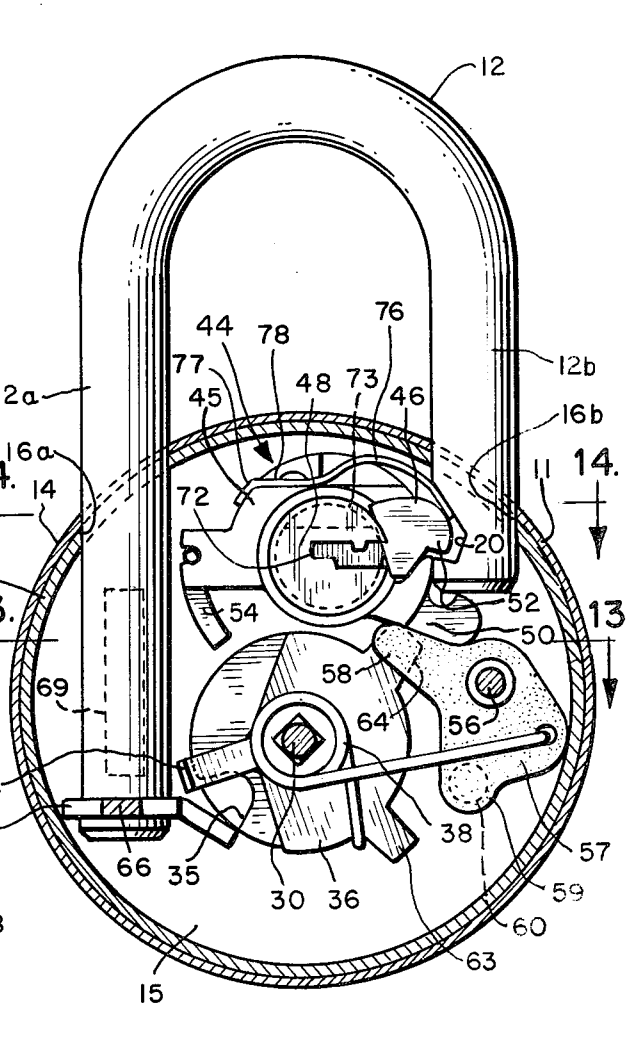
FIG. 3 is a vertical sectional view taken along lines 3—3 of FIG. 2.
Figure 2:
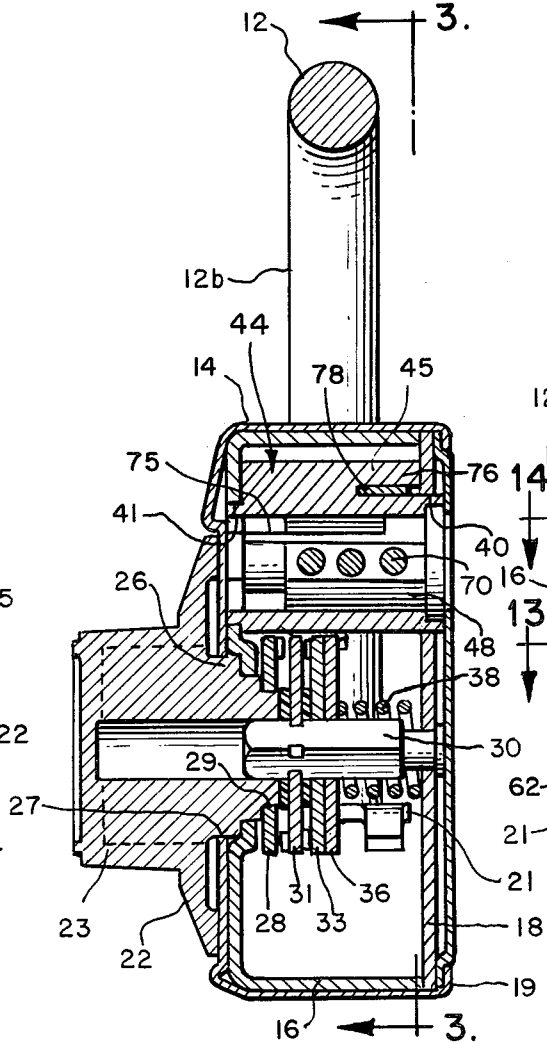
FIG. 2 is a vertical sectional view taken along the line 2—2 of FIG. 1, the padlock being in locked condition.
Figure 1:
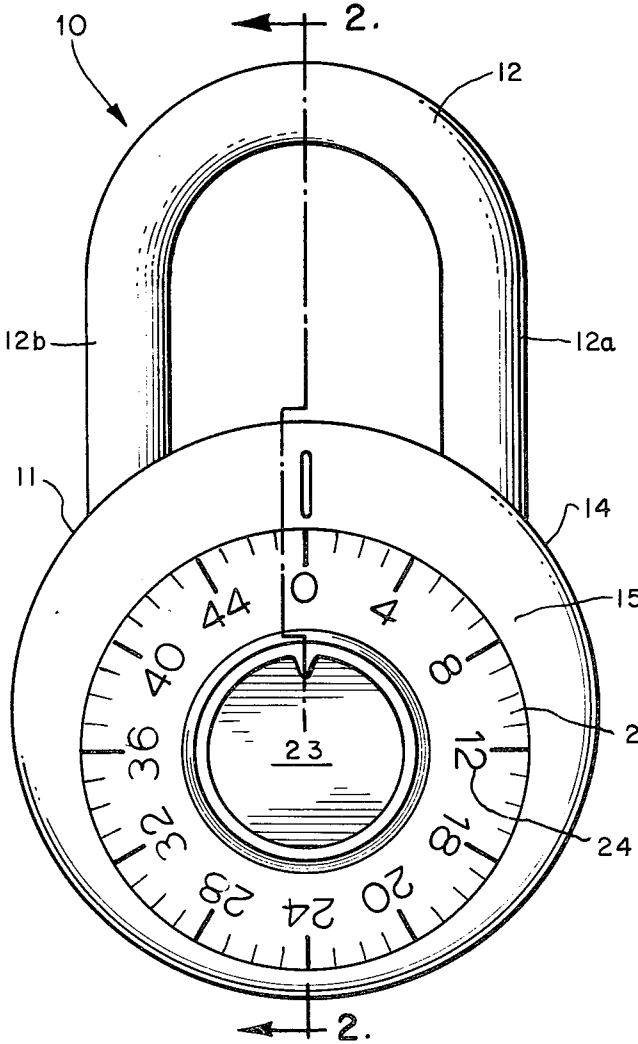
FIG. 1 is a front elevational view of a dual combination and key padlock embodying the teachings of the invention set forth herein.

Referring now to the drawings and specifically FIGS. 1, 2 and 3 the reference numeral 10 indicates a padlock comprising a body member 11 and a shackle 12. The body member 11 is comprised of a cylindrically shaped shell 14 having a front face 15 and side wall 16, and a back plate 18 secured to said side wall by a rolled over flange as indicated at 19. The shackle 12 is U-shaped having a long leg 12*a* and a short leg 12*b* extending through side wall openings 16*a* and 16*b*, respectively. The short leg 12*b* has a locking notch 20 formed therein adjacent its terminus and the long leg 12*a* has a guide member 21 secured thereto at its terminus, the function of both to be described later.

A dial 22 having a knob 23 and the scale markings indicated by reference numberal 24 has a hollow stem portion 26 extending through an opening 27 in the shell front face 15 to abutment with and securement to a first disc member 28 having a central bore 29. A shaft 30 formed integral with the back plate 18 extends through the disc 28 and into the hollow stem 26 thereby providing an axle about which the dial 22 can be rotated. A second disc 31 and third disc 33 rotatably mounted on shaft 30 can be rotated by and in coordination with the first disc 28 in a manner well known in the art to align peripheral notches in the discs, as indicated by reference numeral 35 in FIG. 4. Inasmuch as the construction and operation of the dial and disc assembly is all conventional and, as such, does not constitute a part of the invention disclosed herein, no detailed description is necessary for a complete understanding of said invention. Also mounted on shaft 30 is a disc upsetter 36 and a compression spring 38, the function of both to be described later.

Figure 14:
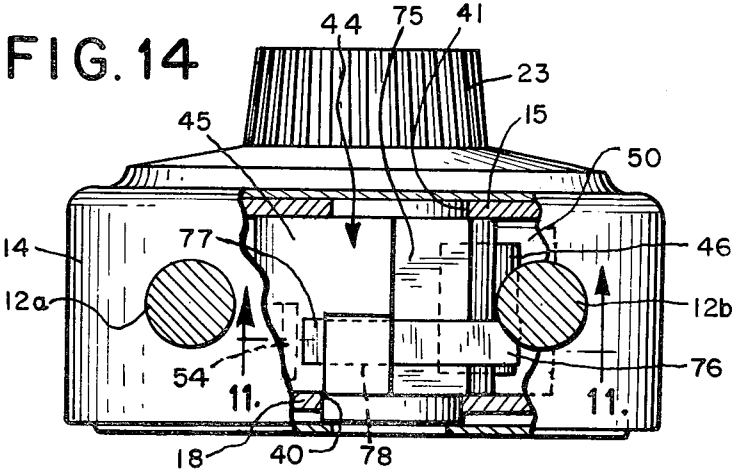
FIG. 14 is a horizontal sectional view taken along lines 14—14 of FIG. 3.

Referring now to FIGS. 2, 3 and 14, a journal 40 formed in the back plate 18 is aligned with a similar journal 41 formed in the front face 15, and together they provide bearing surfaces for a rotatable locking mechanism 44 mounted therein and disposed between the back plate and front face. The locking mechanism 44 comprises a housing member 45, a bolt 46, and a key cylinder 48 which, as shown, function as a unitary element to maintain the padlock in a locked position, as will now be described.

The housing 45 is formed to provide a rocker arm 50 extending outwardly and downwardly to a position underlying the shackle short leg 12*b* and spaced apart from the bolt 46, said bolt having a notched end portion 52 disposed within the locking notch 20 of the shackle 12. An arcuate tongue 54 extending outwardly and downwardly from the housing 45 in diametric opposition to the bolt 46 is disposed adjacent the peripheries of discs 28, 31 and 33. As shown, any movement of the shackle 12 upwardly will cause locking notch 20 to apply upward pressure against bolt 46 thereby rotating the housing 45 in a counterclockwise direction. However, such rotation will move the tongue 54 into abutment with the peripheral portions of discs 28, 31 and 33 thereby preventing further rotation, and thereby maintaining the interlocking relationship between shackle notch 20 and bolt notch 52.

Still referring to FIGS. 2, 3 and 14 a stud 56 formed integral with the back plate 18 has an upsetter pawl 57 mounted thereon, said pawl having a lever arm 58 extending upwardly and outwardly to disposition underlying rocker arm 50 of the locking mechanism 44, and a downwardly extending arm 59 having a cam pin 60 extending laterally therefrom. As best seen in FIG. 3, disc upsetter 36 has a lever arm 62 extending outwardly to disposition adjacent shackle guide 21 and spaced apart lugs 63 and 64 extending outwardly to disposition adjacent upsetter pawl 57. Compression spring 38 has one end secured to upsetter lug 63 and the other end secured to the upsetter pawl arm 59 whereby any clockwise rotational movement of the disc upsetter 36 will result in clockwise rotational movement of the upsetter pawl 57, thereby moving cam pin 60 into the path of arcuate travel of upsetter lug 64, for a purpose to now be described.

Figure 5:
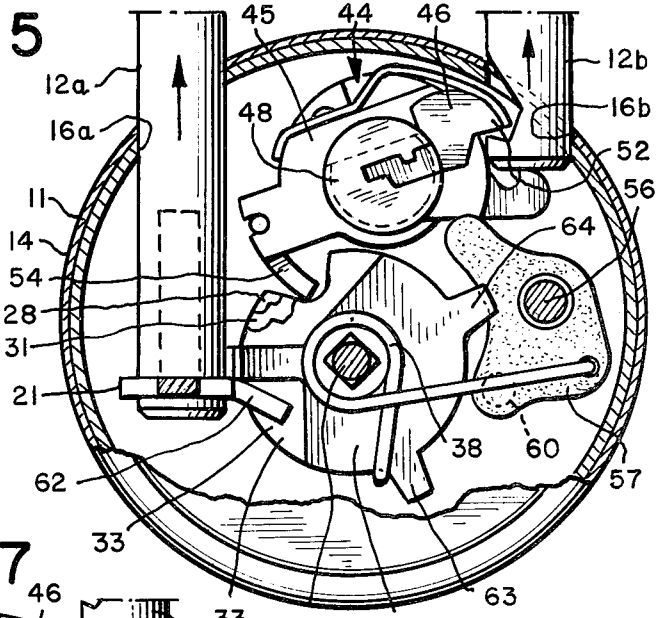
FIG. 5 is a view similar to FIG. 4, but with the shackle moved upwardly to rotate the locking mechanism and the disc upsetter.
Figure 4:
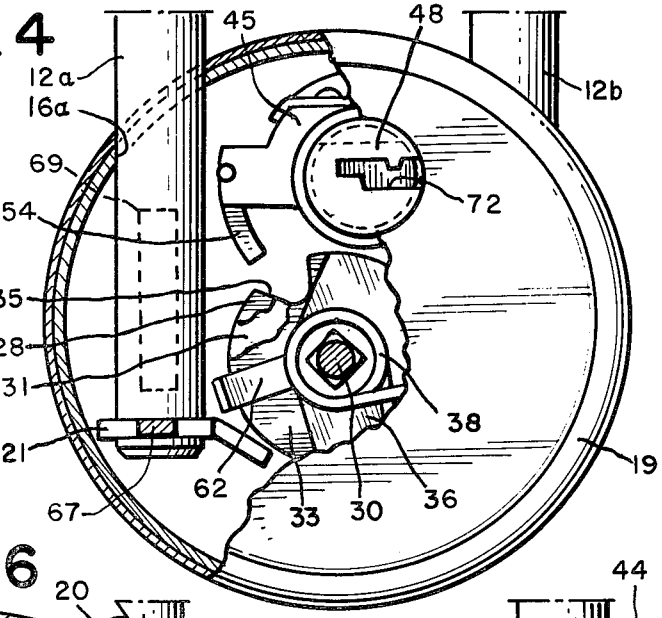
FIG. 4 is a view similar to FIG. 3, but with the combination correctly dialed and the super-imposed discs in registration.

As seen in FIG. 4, manipulation of dial 22 through a correct combination has, in a well known manner, rotated the discs 28, 31 and 33 to align peripheral notches in the discs, as indicated by reference numeral 35. Movement of shackle 12 upwardly, see FIG. 5, moves shackle notch 20 upwardly against bolt 46 causing counterclockwise rotation of the unitary locking mechanism 44, such rotation being permitted since the aligned notches 35 allow the tongue 54 to move past the periphery of discs 28, 31 and 33. Such upward movement of the shackle 12 also moves shackle guide 21 upwardly against upsetter lever arm 62 thereby rotating upsetter 36 clockwise. The rotational movement of upsetter 36 places spring 38 under tension, and inasmuch as the simultaneous rotation of the locking mechanism 44 has moved the rocker arm 50 away from abutment with the pawl lever arm 58, the spring tension causes pawl 57 to also rotate in a clockwise direction moving the cam pin 60 into the path of movement of upsetter lug 64.

Figure 7:
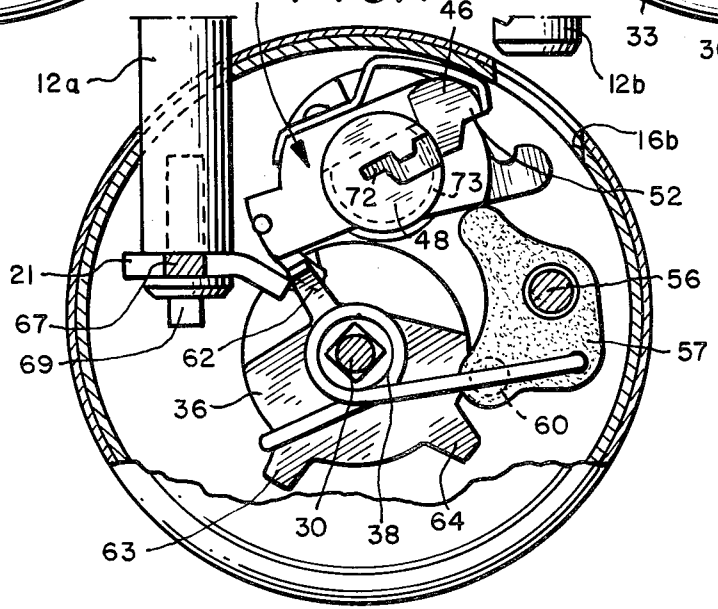
FIG. 7 is a view similar to FIG. 6, but with the shackle moved upwardly out of the padlock body and the upsetter pawl in restraining engagement with the disc upsetter.
Figure 6:
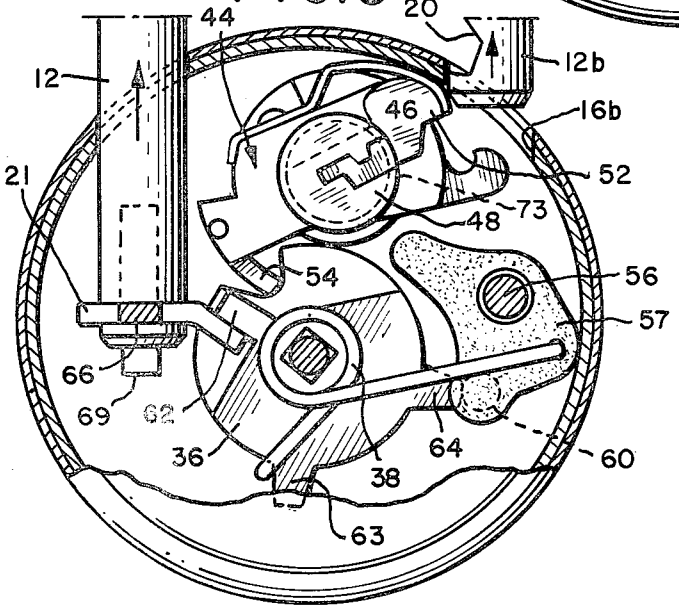
FIG. 6 is a view similar to FIG. 5, but with the shackle moved further upwardly to rotate the disc upsetter into camming abutment with the upsetter pawl.
Figure 9:
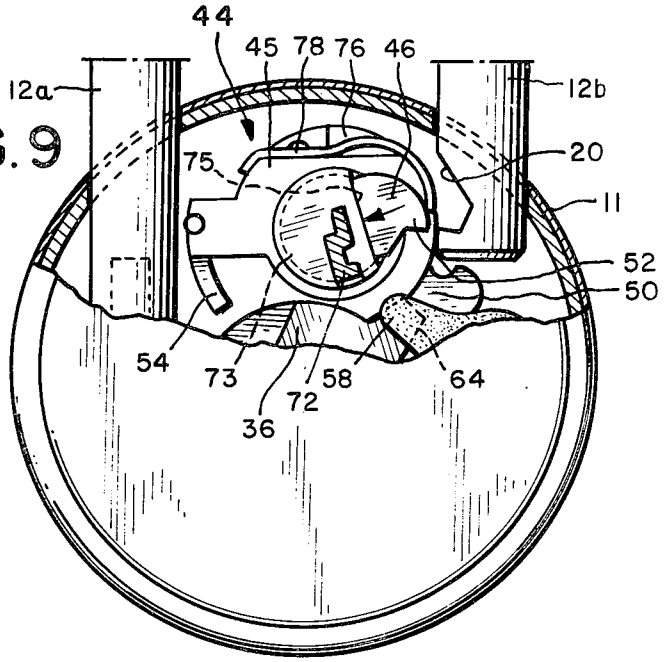
FIG. 9 is a view similar to FIG. 3, but with the key cylinder rotated to move the bolt out of engagement with the shackle.

As shown in FIG. 6, continued movement of the shackle 12 upwardly continues the rotation of upsetter 36 causing lug 64 to work against cam pin 60 and rotate the pawl 57 in a counterclockwise direction in opposition to the tension of spring 38. As shown in FIG. 7, further upward movement of the shackle 12 further rotates the upsetter 36 moving the lug 64 below cam pin 60, at which moment the tension of spring 38 causes the pawl 57 to rotate in a clockwise direction moving the cam pin 60 into a position abutting and overlying the lug 64. The tension of spring 38 urges counterclockwise rotation of the upsetter 36, which rotation is prevented by the abutment of lug 64 with cam pin 60, and urges clockwise rotation of the pawl 57, which rotation is prevented by the abutment of lever arm 58 with rocker arm 50. It is noted that the abutment of lever arm 58 with rocker arm 50 also operates to prevent a clockwise rotation of the locking mechanism 44, the purpose of which will be discussed more fully later. The padlock is now in an unlocked condition and the shackle 12 can be turned about the axis of long leg 12*a* as may be required.

Figure 13:
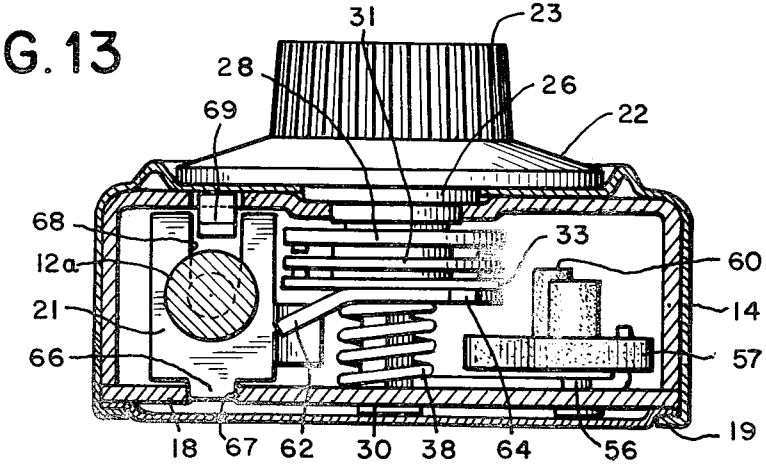
FIG. 13 is a horizontal sectional view taken along line 13—13 of FIG. 3.

As best seen in FIG. 13, the shackle guide 21 has a lug 66 extending outwardly to disposition within a vertical channel 67 formed in the back plate 18, and a notch 68 which receives a vertical rail member 69 formed in the front face 15, said channel and rail maintaining the vertical stability of the shackle long leg 12*a* as it moves up and down in operation, and particularly when shackle short leg 12*b* is outside the padlock body 11.

Figure 8:
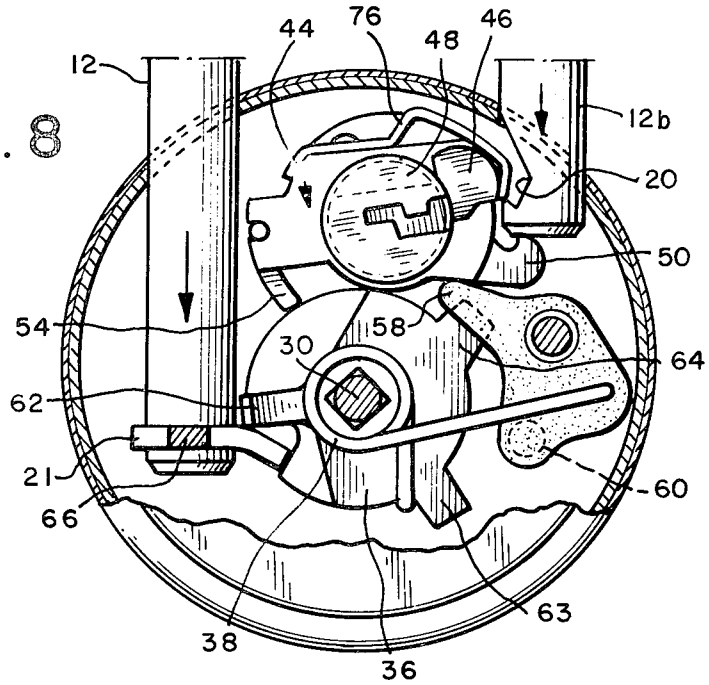
FIG. 8 is a view similar to FIG. 7, but with the shackle moved downwardly to rotate the locking mechanism.

Operation of the padlock to return it to a locked condition can best be described with reference to FIG. 8. As shown, the shackle 12 has been moved downwardly to place shackle short leg 12*b* into abutment with rocker arm 50, thereby rotating locking mechanism 44 clockwise to move tongue 54 upwardly out of the aligned notches 35. Simultaneously, the downward movement of rocker arm 50 acts against lever arm 58 to rotate pawl 57 in a counterclockwise direction in opposition to the tension of spring 38, moving cam pin 60 outwardly. Continued downward movement of the shackle 12 moves cam pin 60 out of abutting engagement with upsetting lug 64, at which moment the tension of spring 38 causes rapid rotation of the upsetter 36 in a counterclockwise direction to the position shown in FIG. 3. This rapid rotation of the upsetter 36 is translated to disc 33 through frictional engagement therebetween, see FIG. 2, thereby rotating said disc in a counterclockwise direction so that the notch 35 of said disc is no longer aligned with the notches 35 of the discs 28 and 31.

Figure 11:
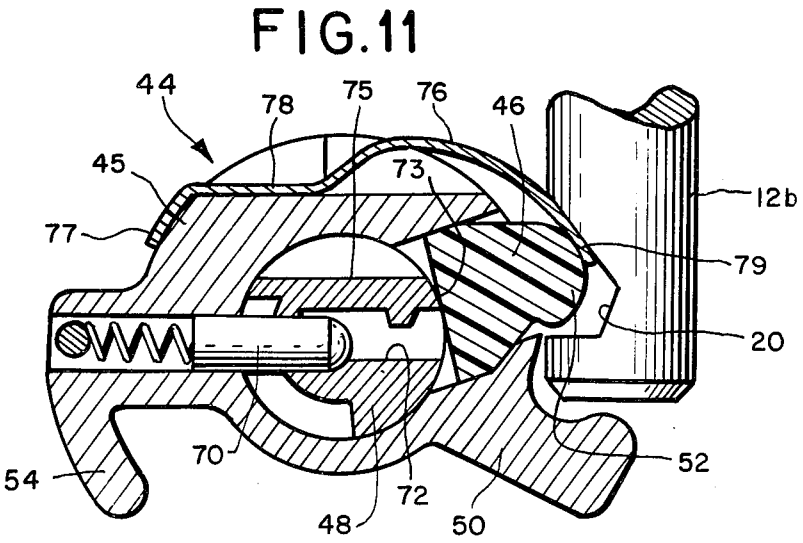
FIG. 11 is an enlarged sectional view of the locking mechanism showing the bolt in shackle engaging position.

Having now described the operation of the combination mechanism to unlock the padlock, reference is made to FIGS. 2, 9, 11 and 12 for an explanation of the key mechanism operation. As best seen in FIGS. 2 and 11, the key cylinder 48 has a series of drive pins 70 which function in a well known manner to interlock the cylinder 48 with the housing member 45, and which when a proper key is inserted into slot 72 can be disengaged from said interlock to permit rotation of the cylinder 48 within the housing member 45. As shown, when the cylinder 48 is interlocked with the housing member 45, bolt 46 which is reciprocatably mounted in housing 45 is maintained in the position illustrated by abutment with the cylinder surface 73, and said bolt can only be displaced from locking engagement with shackle notch 20 through operation of the combination mechanism as previously described.

Figure 12:
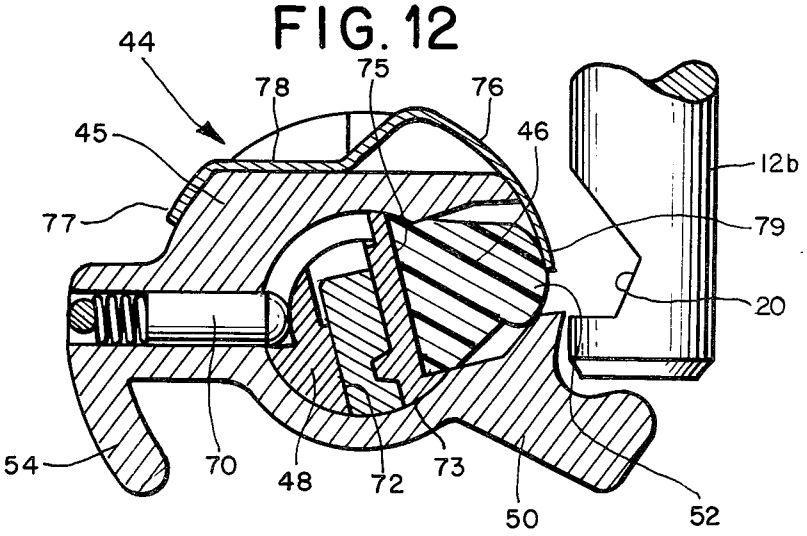
FIG. 12 is a view similar to FIG. 11, but showing rotation of the key cylinder to disengage the bolt from the shackle.

As best seen in FIGS. 2 and 12, when the key cylinder 48 is rotated clockwise approximately 90 degrees a reduced shoulder portion 75 of said cylinder is disposed adjacent bolt 46. Leaf spring 76, see FIG. 14, having one end 77 attached to the housing member 45 as indicated at 78 has the other end 79 engaging the bolt end portion 52, whereby the tension of said spring urges the bolt 46 axially inward. As shown, the bolt 46 is withdrawn from locking engagement with shackle notch 20. This is the key operated unlocked condition illustrated in FIG. 9 in which the shackle 12 is now free to be moved upwardly.

Figure 10:
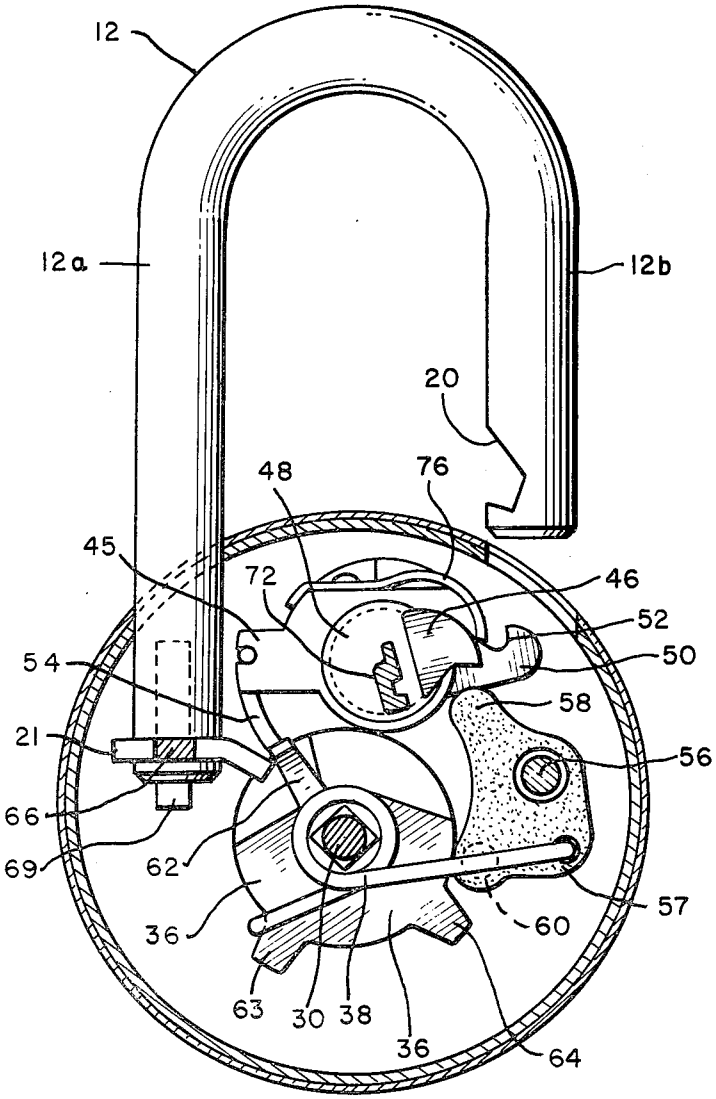
FIG. 10 is a view similar to FIG. 4, but with the shackle moved upwardly to rotate the disc upsetter into camming abutment with the upsetter pawl.

As shown in FIG. 10, the shackle 12 has been moved upwardly to dispose shackle short leg 12*b* outside of the padlock body 11. During the upward movement of shackle 12, the shackle guide 21 moved upwardly against upsetter lever arm 62 thereby rotating upsetting 36 clockwise, and through the camming action of lug 64 against cam pin 60 actuated pawl 57 to permit entrapment of said lug by said cam pin. In such condition the upsetter 36 is restrained by pawl 57, maintaining lever arm 62 out of contact with shackle guide 21 whereby the shackle 12 is free from the spring tension of spring 38. To return the padlock to a locked condition shackle short leg 12*b* is moved downwardly to engagement with rocker arm 50, thereby moving lever arm 58 downwardly and rotating pawl 57 sufficiently to move cam pin 60 away from lug 64, spring 38 causing upsetter 36 to rotate counterclockwise, whereupon manual rotation of the key cylinder 48 counterclockwise will cause cylinder surface 73 to cam bolt 46 outwardly to the position shown in FIGS. 3 and 11.

When the padlock is in a locked condition, as illustrated in FIGS. 3 and 11, the locking mechanism 44, comprising housing 45, bolt 46 and cylinder 48, is a rigid, unitary member, and when the padlock is unlocked as shown in FIG. 7 the locking mechanism 44 has been rotated, as previously described, by upward movement of the shackle 12, thereby moving the bolt end portion 52 out of locking engagement with the shackle notch 20. It is important that the locking mechanism 44 not be returned to the locked position of FIG. 3 while the shackle short leg 12*b* is outside the padlock since dispostion of the bolt 46 underlying the shackle short leg 12*b* would prevent full downward movement of the shackle, thereby preventing a locking engagement between the bolt and shackle. As previously described, the upward force of pawl lever arm 58 against rocker arm 50 maintains the locking mechanism 44 in a fully rotated unlocked position, with tongue 54 disposed within the aligned disc notches 35. It should be apparent that maintaining the locking mechanism 44 in an unlocked position while the shackle short leg 12*b* is outside the padlock requires that the disc notches 35 be maintained in an aligned position. Thus, the disc upsetter 36 cannot be permitted to upset, or move, disc 33 until shackle short leg 12*b* has been inserted to dispose shackle notch 20 in position to receive bolt end portion 52. As shown in FIG. 8, such disc upsetting occurs on the downward movement of the shackle and only after the locking mechanism has been returned to a locked position.

It should be noted that the invention as herein described provides essentially a "dead-bolt" type of locking mechanism for the combination mechanism operation. This produces not only a strong padlock but one that is not susceptible to being "sprung" since there is no spring or resilient function utilized in maintaining a locked condition. Also, in utilizing the key mechanism as an integral part of the locking mechanism this invention provides a padlock of simple and economical construction.

While I have described my invention in terms of a preferred embodiment, it should be obvious that modifications are possible within the teachings disclosed herein without departing from the scope of the invention as hereafter claimed.

What is claimed is:

1. A padlock comprising a body member having openings therein, a shackle having legs slidable in said openings, one of said legs having a notch therein, a rotatable locking mechanism having a slidable bolt extending therefrom into said notch, a rotatable key mechanism disposed concentrically within said locking mechanism and operable in one position to maintain said bolt extending into said notch, and operable in another position to retract said bolt from said notch, and a combination mechanism operable to rotate the locking mechanism to move the bolt out of the notch when the key mechanism is in one position to maintain said bolt extending into the notch.

2. A padlock comprising a body member having openings therein, a shackle having legs slidable in said openings, one of said legs having a notch therein, a locking mechanism comprising a rotatable housing with a bolt extending therefrom into said notch, a rotatable key cylinder disposed concentrically within the housing and releasably secured thereto, a portion of the cylindrical surface of said key cylinder abutting said bolt to maintain said bolt extending into the notch, a combination mechanism operable to rotate the housing and thereby move the bolt out of the notch, and means for releasing the key cylinder from securement to the housing and rotating said key cylinder independently of the housing to retract said bolt from said notch.

3. A padlock according to claim 2 wherein rotation of the key cylinder independently of the locking mechanism housing moves the portion of the cylindrical surface of the key cylinder abutting the bolt out of abutment with said bolt.

4. A padlock according to claim 3 wherein the key cylinder has a reduced shoulder portion formed adjacent the portion of the cylindrical surface of the key cylinder abutting the bolt, and rotation of the key cylinder independently of the locking mechanism housing moves said reduced shoulder portion into position for abutting said bolt.

5. A padlock according to claim 4 wherein the locking mechanism includes spring means biasing the bolt inwardly to abutment with the key cylinder.

* * * * *